US006409405B1

(12) United States Patent
Eddington

(10) Patent No.: US 6,409,405 B1
(45) Date of Patent: Jun. 25, 2002

(54) FOUNTAIN PEN WITH LEAK PROOF PISTON CONVERTER

(75) Inventor: Ryan S. Eddington, Dallas City, IL (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/493,921

(22) Filed: Jan. 28, 2000

(51) Int. Cl.[7] ..... B43K 5/08
(52) U.S. Cl. ..... 401/174; 401/182
(58) Field of Search ..... 401/172, 173, 401/174, 175, 182, 222

(56) References Cited

U.S. PATENT DOCUMENTS

| | | | | |
|---|---|---|---|---|
| 2,123,406 A | * | 7/1938 | Deli | 401/174 |
| 2,167,815 A | | 8/1939 | Rosler et al. | |
| 2,258,841 A | | 10/1941 | Biro | |
| 3,453,057 A | | 7/1969 | König | |
| 4,753,819 A | | 6/1988 | Shimada | 427/96 |
| 5,406,991 A | | 4/1995 | Rathenberg et al. | 141/18 |
| 5,494,082 A | | 2/1996 | Rathenberg | 141/18 |
| 5,511,592 A | | 4/1996 | Kiel | 141/23 |

* cited by examiner

*Primary Examiner*—Gregory L. Huson
*Assistant Examiner*—Peter deVore
(74) *Attorney, Agent, or Firm*—Pennie & Edmonds LLP

(57) ABSTRACT

A piston converter for a fountain pen that permits a user to selectively engage the drive mechanism to the converter is disclosed. The converter has a hollow body fluidly connected to a nib of the pen at one end and a plunger assembly slidably disposed therein. The plunger assembly is engaged to a hollow drive rod. An engagement rod with a first end and an engagement end extends into the drive rod. The drive rod has an internal cavity configured to engage the engagement end of the engagement rod. The engagement end of the engagement rod can be selectively moved into or out of the engagement cavity, thereby permitting selective engagement of the drive mechanism for the piston converter.

19 Claims, 6 Drawing Sheets

FOUNTAIN PEN WITH LEAK PROOF PISTON CONVERTER

FIELD OF THE INVENTION

The present invention relates generally to fountain pens and more specifically to the refillable ink cartridges used in fountain pens.

BACKGROUND OF THE INVENTION

In general there are three methods of supplying ink to a fountain pen: (1) dipping the nib directly into an ink well to coat the same with ink; (2) providing a disposable ink cartridge that is inserted into the body of the pen such that fluid communication is established between the ink cartridge and the nib to supply the same with ink; and (3) providing a refillable ink cartridge that is either removable from or integral with the body of the pen and such that fluid communication is established between the ink cartridge and the nib. The refillable ink cartridges are often referred to as piston converters by the skilled artisan. A piston converter, in general, is a hollow body with a plunger slidably disposed therein. The hollow body is fluidly connected at one end to the nib of a fountain pen. In order to fill a piston converter with ink, the plunger is pushed forward into the hollow body, the nib of the pen is substantially submerged into a well of ink (in the case of a removable type converter, an end of the hollow body is inserted into the well of ink), and the plunger is withdrawn, thereby drawing ink into the hollow body; the operation is analogous to drawing fluid into a syringe. The plunger remains in the hollow body, thereby sealing one end of the hollow body. The second end of the hollow body, as mentioned above, is in fluid communication with the nib. After filling the piston converter the pen can be used until the ink runs dry, after which the process is repeated to fill the piston converter with ink again. In some cases a removable piston converter can be replaced by a disposable cartridge if the user prefers disposable cartridges over piston converters.

In one prior art piston converter the plunger is moved within the hollow body by a drive mechanism. The general concept of the drive mechanism uses a plunger shaft connected to the plunger and a drive member fixed relative to the hollow body and engaged with the plunger shaft. The plunger shaft has either external or internal threads, and the drive member has threads that mate with the threads of the plunger shaft. Because the drive member is fixed relative to the hollow body, turning the drive member causes its threads to rotate, which causes the plunger shaft to move longitudinally relative to the hollow body. Thus, turning the drive member moves the plunger within the hollow body permitting a user to draw ink into the hollow body.

One disadvantage to using this drive mechanism for piston converters is that the drive member is often inadvertently rotated, thereby causing a relatively large quantity of ink to discharge out of the nib. This inadvertent ink discharge can stain clothes, hands, fingers, it can ruin documents and virtually anything else it contacts. Likewise, inadvertently rotating the drive knob may cause air to be drawn into the hollow body, thereby affecting the performance of the pen. Thus, there is a need in the art for a piston converter with a drive mechanism that a user selectively activates, which, among other things, will substantially prevent the accidental discharge of ink from a fountain pen.

SUMMARY OF THE INVENTION

A preferred embodiment of a piston converter in accordance with the present invention includes a hollow body having a distal end and a proximal end, a plunger assembly, a metering knob, a drive rod, and an engagement rod. The distal end of the hollow body provides fluid communication between the hollow body and a nib of a fountain pen. The plunger assembly, preferably a plunger attached to a plunger rod, is slidably disposed in the hollow body. The metering knob is configured to engage the plunger assembly, preferably the plunger rod, to advance or withdraw said plunger within said hollow body. The drive rod is configured to engage the metering knob such that turning the drive rod will turn the metering knob, which will advance or withdraw the plunger assembly. An engagement end of the engagement rod is configured to selectively engage the drive rod, preferably by drawing or pushing the engagement end into or out of a cavity within the drive rod configured to engage the engagement end, such that when in the engaged position turning the engagement rod will cause the drive rod to turn which will cause said metering knob to advance or withdraw said plunger within said hollow body.

DETAILED DESCRIPTION OF THE PREFERRED EMBODIMENTS

Figure 1:
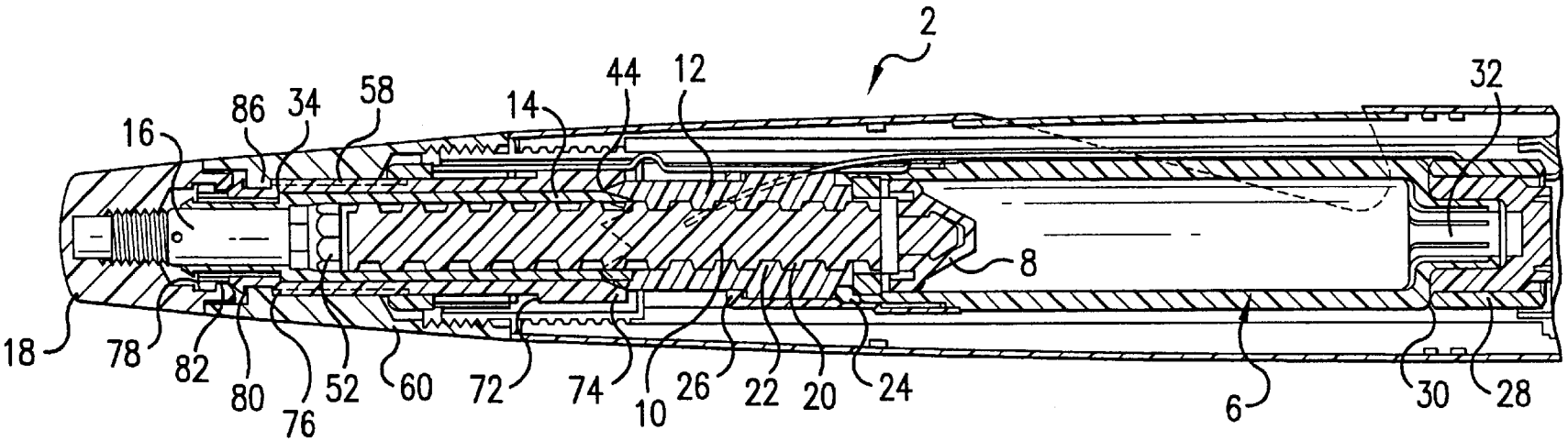
FIG. 1 is a partial cross-sectional view of a fountain pen with a piston converter in accordance with an embodiment of the present invention.
Figure 2A:
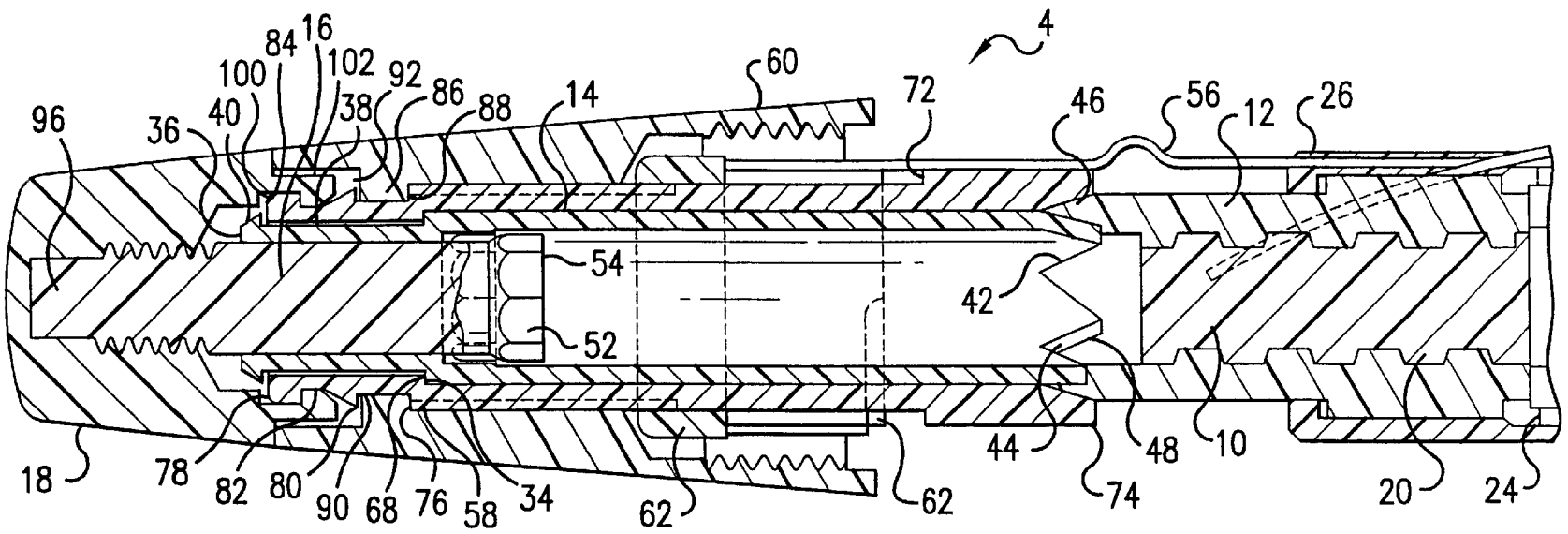
FIG. 2A is an enlarged partial cross-sectional view of the top half of the fountain pen and piston converter of FIG. 1.

Referring to FIGS. 1 and 2 there is shown a fountain pen 2 with piston converter 4 in accordance with an embodiment of the present invention. Piston converter 4 has a hollow body 6, a plunger 8, a plunger rod 10, a metering knob 12, a drive rod 14, an engagement rod 16, and a drive knob 18.

Figure 2B:
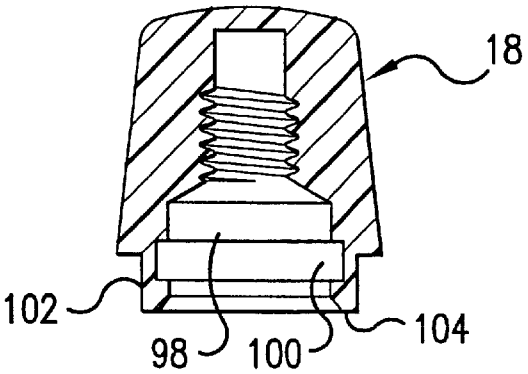
FIG. 2B is a cross-sectional view of a drive knob from the fountain pen in FIGS. 1 and 2A.
Figure 3:
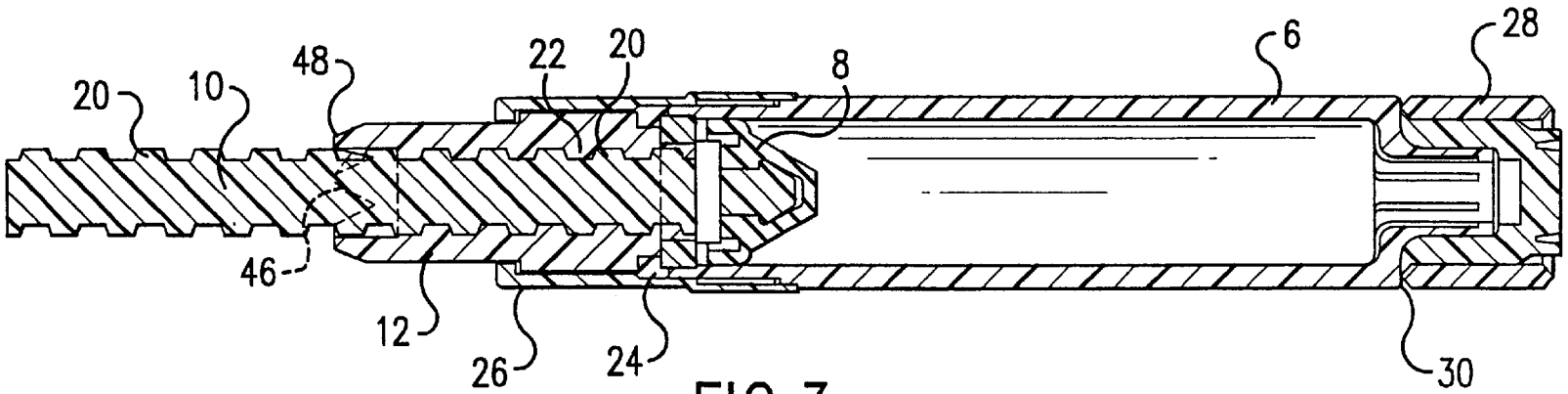
FIG. 3 is a cross-sectional view of a hollow body from the fountain pen and piston converter of FIGS. 1 and 2A.

Referring to FIGS. 1–3, plunger 8 is slidably disposed in hollow body 6. Plunger rod is attached to plunger 8 and has external threads 20. Metering knob 12 is preferably a hollow cylinder with internal threads 22 configured to engage external threads 20 of plunger rod 10. In an alternative embodiment the metering knob has external threads that engage internal threads in a hollow plunger rod. A skilled artisan will readily recognize that other means of engagement between metering knob 12 and plunger rod 10 may be used without departing from the scope of the present invention. Metering knob 12 abuts proximal end 24 of hollow body 6, and is fixed relative thereto, for example, by crown 26. Cover 28 is affixed to distal end 30 of hollow body 6 and has an orifice (not shown) therethrough to provide fluid communication between hollow body 6 and tube 32 and to provide fluid communication from hollow body 6 to a nib (not shown) of fountain pen 2.

Figure 4:
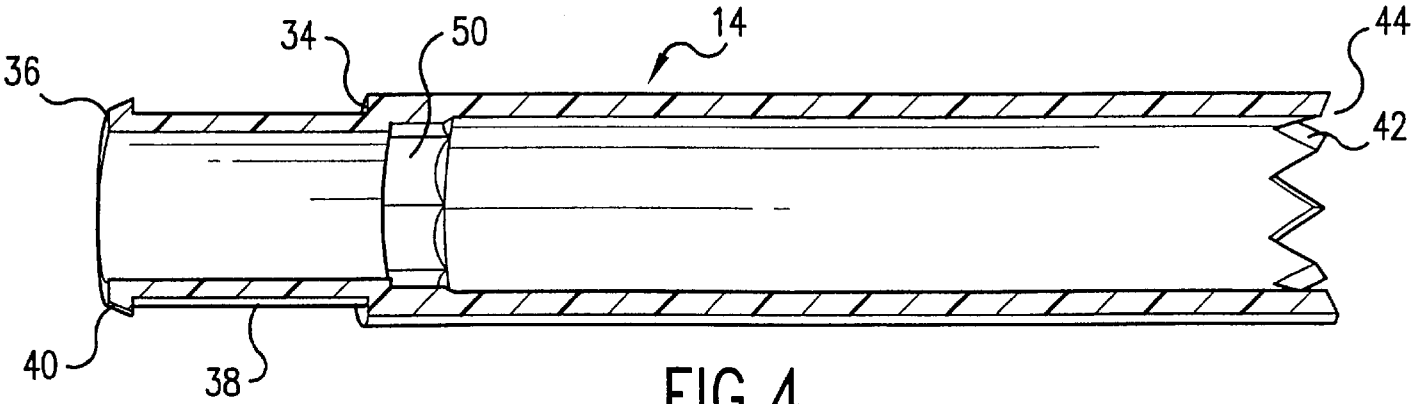
FIG. 4 is a cross-sectional view of a drive rod from the piston converter depicted in FIGS. 1 and 2.
Figure 5:
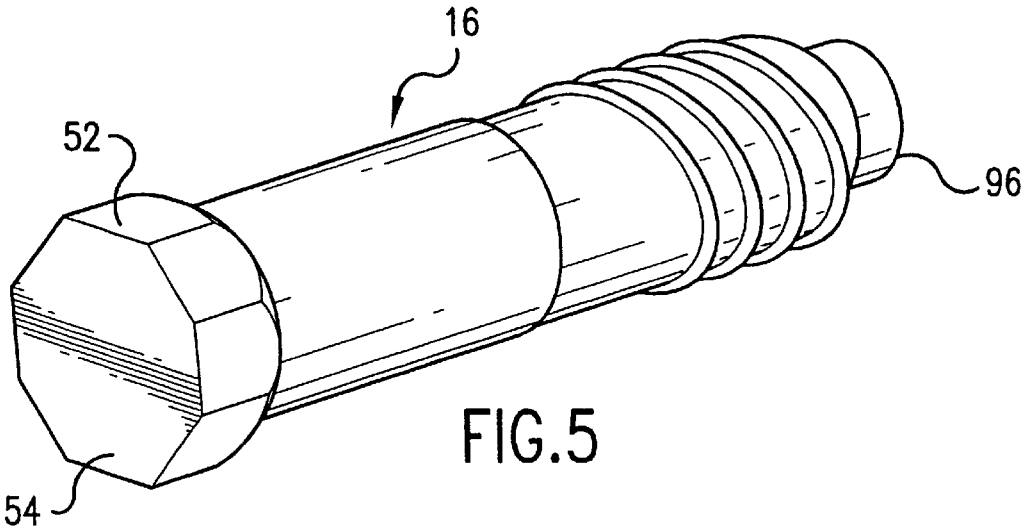
FIG. 5 is a three-dimensional view of an engagement rod from the fountain pen and piston converter of FIGS. 1 and 2A.

Referring to FIGS. 1, 2, and 4, drive rod 14 is preferably a hollow cylinder. Externally, drive rod 14 has ridge 34 towards its proximal end 36, followed by a narrower straight cylindrical region 38 and then by circular barb 40 at its proximal end 36. Drive rod 14 has teeth 42 at its distal end 44 that engage similarly shaped teeth 46 on proximal end 48 of metering knob 12 (the latter is best shown in FIG. 3). A skilled artisan will readily recognize that other alternatives for this engagement may be used, including without limitation, permanently joining the two pieces. Internally, drive rod 14, towards proximal end 36, has nut cavity 50 configured to engage with nut 52 on distal end 54 of engagement rod 16 (the latter is best shown in FIG. 5), which is described in more detail below.

Figure 6:
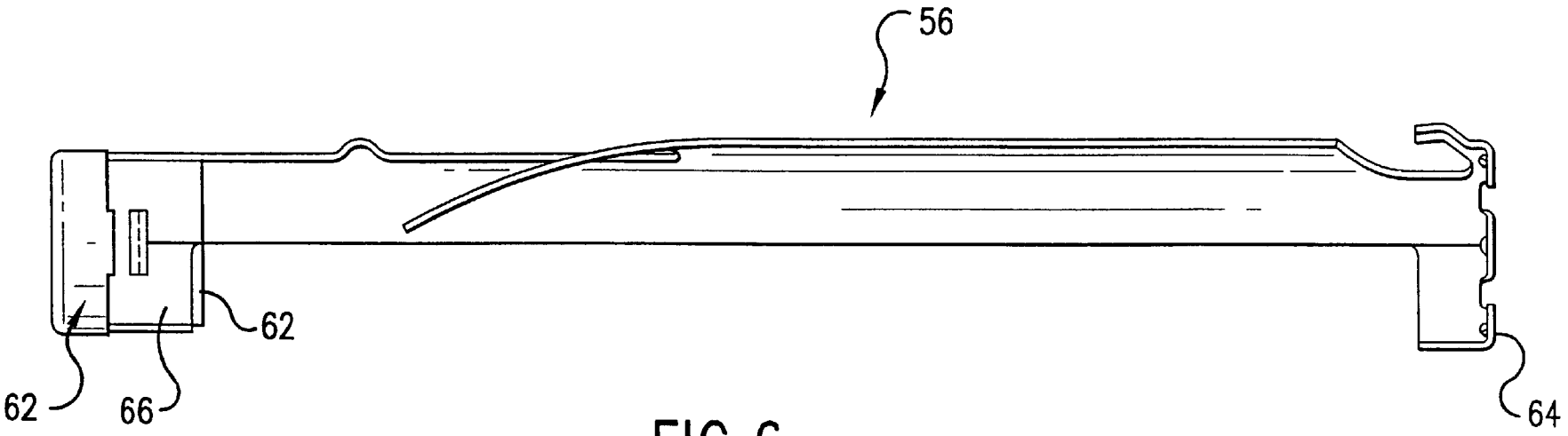
FIG. 6 is a cross-sectional view of a drawer from the fountain pen and piston converter of FIGS. 1 and 2A.
Figure 7:
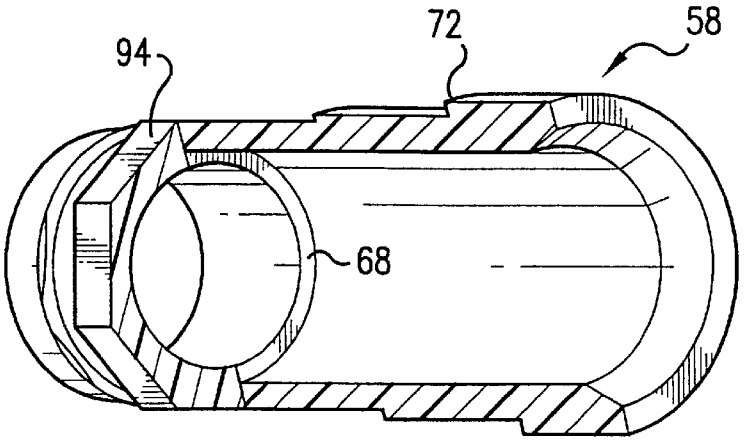
FIG. 7 is a cutaway three-dimensional view of a sleeve from the fountain pen and piston converter of FIGS. 1 and 2A.
Figure 8:
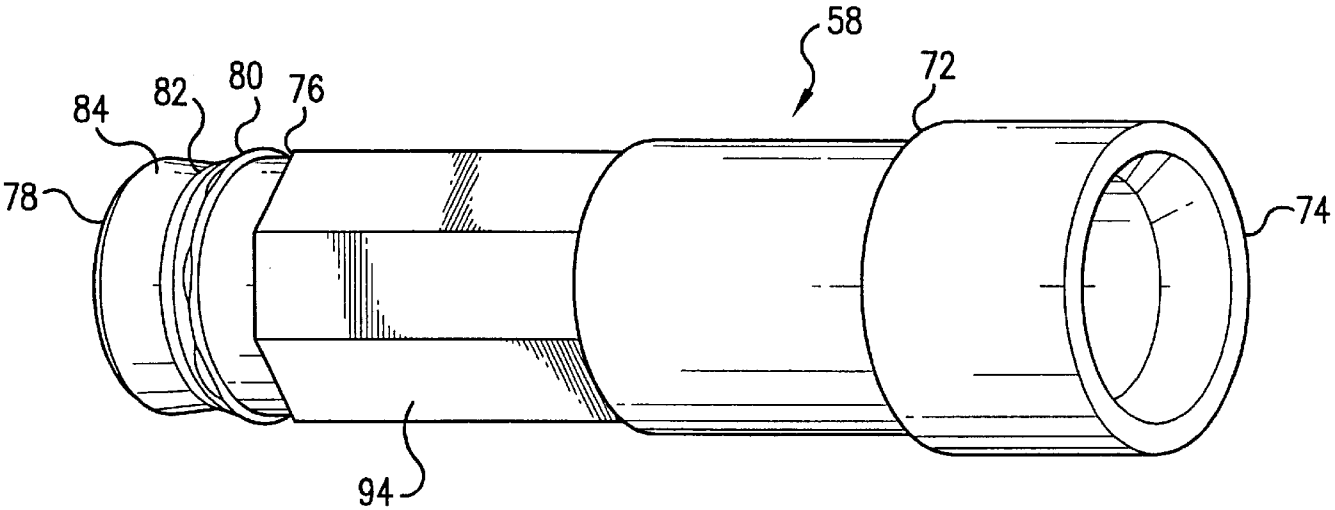
FIG. 8 is a three-dimensional view of a sleeve from the fountain pen and piston converter of FIGS. 1 and 2A.

Referring to FIGS. 1–3, and 6–8, piston converter 4 is secured in pen 2 by drawer 56, sleeve 58, cap 60, and cylindrical collar 62. Drawer 56 (best shown in FIG. 6) is half of a hollow cylinder with distal band 64 and proximal band 66. Distal band 64 receives cover 28 of hollow body 6. Proximal band 66 secures cylindrical collar 62 to drawer 56. Cylindrical collar 62 receives sleeve 58 therethrough. Referring to FIGS. 6 and 7, sleeve 58 is a hollow cylinder. Internally, sleeve 58 has ridge 68 configured to abut ridge 34 of drive rod 14 (the latter is best shown in FIGS. 2A and 4) when the two pieces are mated together, as more fully described below. Externally, sleeve 58 has abutment 72 towards its distal end 74, shelf 76 towards its proximal end 78 followed by rim 80, followed by indentation 82 and then by flared rim 84 that preferably has a slightly smaller outer diameter than rim 80.

Proximal end 78 of sleeve 58 slides into and through collar 62 and is snap fit into cap 60 such that rim 80 snaps over the top of concentric ring 86 of cap 60, and such that shelf 76 of sleeve 58 abuts distal side 88 of concentric ring 86. Additionally, when sleeve 58 is snap fit into cap 60, flared rim 84 extends through hole 90 and into cylindrical cavity 92 of cap 60. In this manner drawer 56 and sleeve 58 are affixed to cap 60, because abutment 72 prevents collar 62 from passing over distal end 74 of sleeve 58, and sleeve 58 is fixed into cap 60 by rim 80, as previously described. The octagonal shape 94 of the central portion of sleeve 58 (best shown in FIG. 7) is configured to mate with a similarly shaped surface (not shown) inside of cap 60, thus preventing rotation of sleeve 58 within cap 60.

Referring to FIGS. 1 and 2, proximal end 36 of drive rod 14 is slid into distal end 74 of sleeve 58 such that circular barb 40 snap fits over flared rim 84 of sleeve 58 and such that drive rod 14 may rotate with respect to sleeve 58. Proximal end 96 of engagement rod 16 extends out of proximal end 36 of drive rod 14 and drive knob 18 is fixed thereto by adhesive and threads. The skilled artisan will recognize many other ways of fixing drive knob 18 to engagement rod 16, such as and without limitation, press fitting, locking threads, or pins.

Referring to FIG. 2B, drive knob 18 has internal cavity 98 with groove 100 around the inside wall thereof, and cylindrical ring 102 at distal end 104 of drive knob 18. Cylindrical ring 102 has a smaller outside diameter than the inside diameter of cylindrical cavity 92 of cap 60. When drive knob 18 is pushed in the distal direction into the unengaged position flared rim 84 of sleeve 58 removably snap fits into groove 100. When in the unengaged position, drive knob 18 may preferably rotate about its central axis. When drive knob 18 is pulled in the proximal direction into the engaged position, drive knob 18 snaps out of its unengaged position such that the top of flared rim 84 rests against cylindrical ring 102, which prevents drive knob 18 from returning to the disengaged position unless the user snaps it back into the disengaged position.

Referring to FIGS. 4 and 5, distal end 54 of engagement rod 16 is shaped as nut 52. Nut 52 may have an approximate shape selected from a group consisting of an eight-sided nut, a seven-sided nut, a six-sided nut, or a five-sided nut. When engagement rod 16 is moved in the proximal direction, by unsnapping drive knob 18 into the engaged position, nut 52 engages with nut cavity 50, such that rotation of drive knob 18 causes drive rod 14 to rotate. When engagement rod 16 is moved in the distal direction, by snapping drive knob 18 into the unengaged position, nut 52 disengages from nut cavity 50, such that rotation of drive knob 18 will not cause drive rod 14 to rotate. The specific hex-nut configuration of the preferred embodiment is not necessarily required. The skilled artisan will readily recognize that engagement rod 16 may selectively engage drive rod 14 externally rather than internally, and that selective engagement may be achieved using any number of other alternatives, including without limitation having selective engagement between drive knob 18 and proximal end 96 of engagement rod 16 or drive rod 14. Additionally, the skilled artisan will readily recognize that many alternatives may be used to engage drive rod 14 with engagement rod 16, such as and without limitation shapes with more or less than eight sides may be use, tapered shapes may be used, threads may be used, or teeth may be used.

To use piston converter 4 a user snaps drive knob 18 into the engaged position and rotates it, which rotates drive rod 14, which rotates metering knob 12, which, through engagement of external threads 20 of plunger rod 10 with internal threads 22 of metering knob 12, causes plunger 8 to advance or withdraw within hollow body 6. When the user has drawn ink into hollow body 6, the drive knob is snapped into the disengaged position such that rotation of drive knob 18 will not advance or withdraw plunger 8.

Although various embodiments of the present invention have been described, the descriptions are intended to be merely illustrative. Thus, it will be apparent to the skilled artisan that modifications may be made to the embodiments as described without departing from the scope of the claims set forth below.

What is claimed is:

1. A piston converter for a fountain pen, said piston converter comprising:

a hollow body having a distal end and an opposite proximal end, wherein said distal end is configured to provide fluid communication between said hollow body and a nib of a fountain pen;

a plunger assembly with at least a plunger slidably disposed within said hollow body;

a control member having a distal end and an opposite proximal end, wherein said distal end of said control member is configured to engage said plunger assembly advance or withdraw said plunger within said hollow body;

a drive rod having a distal end and an opposite proximal end, wherein said distal end of said drive rod is configured to engage said proximal end of said control member;

an engagement rod having a first end and an engagement end, said engagement end being configured to selectively engage said drive rod and being moveable between an engaged position and an unengaged position, such that when in said engaged position turning said engagement rod will cause said drive rod to turn, which will cause said control member to advance or withdraw said plunger within said hollow body, and when in said unengaged position turning said engagement rod does not cause said drive rod to turn.

2. The piston converter according to claim 1, wherein:

said plunger assembly comprises a plunger and a plunger rod attached thereto; and said control member engages said plunger rod.

3. The piston converter according to claim 2, wherein said drive rod has a hollow cylindrical shape with an internal cavity configured to selectively engage said engagement end of said engagement rod.

4. The piston converter according to claim 3, wherein:

said engagement end of said engagement rod extends into said drive rod; and said first end of said engagement rod extends out of said proximal end of said drive rod.

5. The piston converter according to claim 4, wherein:

moving said engagement rod in a proximal direction causes the engagement end to engage said internal cavity of said drive rod; and moving said engagement rod in a distal direction causes said engagement end to disengage from said internal cavity of said drive rod.

6. The piston converter according to claim 5, further comprising:

a drawer with a half cylindrical shape and having a distal band and a proximal band, wherein said distal band is configured to receive and secure said distal end of said hollow body, and wherein said proximal band secures a collar; and a sleeve slidably disposed through said collar, wherein said sleeve is a hollow cylinder configured internally to securely receive said drive rod such that said drive rod may rotate relative to said sleeve and such that said drive rod does not significantly move in said distal or proximal directions.

7. The piston converter according to claim 2, wherein said control member has a hollow cylindrical shape with threads therein and said plunger rod has external threads configured to engage said threads of said control member.

8. A piston converter for a fountain pen, said piston converter comprising:

a hollow body having a distal end and an opposite proximal end, where in said distal end is configured to provide fluid communication between said hollow body and a nib of a fountain pen;

a plunger assembly with at least a plunger slidably disposed within said hollow body;

a control member having a distal end and an opposite proximal end, wherein said distal end of said control member is configured to engage said plunger assembly to advance or withdraw said plunger within said hollow body;

an engagement rod having a first end and an engagement end, said engagement end configured to selectively engage said control member and being moveable between an engaged position and an unengaged position, such that when in said engaged position said engagement rod engages said control member to advance or to withdraw said plunger within said hollow body, and when in said unengaged position said engagement rod does not engage said control member.

9. The piston converter according to claim 8, wherein: at least said proximal end of said control member is hollow with an internal portion;

said engagement end of said engagement rod is slidably disposed in said proximal end of said control member; and said engagement end of said engagement rod is configured to engage said internal portion of said proximal end of said control member when said engagement rod is in said engaged position.

10. The piston converter according to claim 9, wherein said distal end of said control member abuts said proximal end of said hollow body and is fixed relative thereto.

11. The piston converter according to claim 9, wherein said engagement end of said engagement rod has the approximate shape selected from the group consisting of an eight-sided nut, a seven-sided nut, a six-sided nuts or a five-sided nut.

12. The piston converter according to claim 11, wherein said control member has a cavity configured to receive to said engagement end of said drive rod.

13. The piston converter according to claim 8, wherein:

said plunger assembly further comprises a plunger rod attached to said plunger, wherein said plunger rod has external threads and extends at least partially out of said proximal end of said hollow body; and said control member has internal threads configured to engage said external threads of said plunger rod, wherein said control member abuts said proximal end of said hollow body and is fixed relative thereto, such that turning said control member advances or withdraws said plunger within said hollow body.

14. A fountain pen comprising:

a hollow body configured for fluid communication with a pen nib;

a plunger assembly within said hollow body; and a rotatable drive knob linearly movable between a first predetermined position in which rotation of said drive knob causes said plunger assembly to move linearly within said hollow body, and a second predetermined position in which rotation of said drive knob does not effect linear movement of said plunger assembly.

15. A fountain pen according to claim 14, further comprising an engagement rod coupled to said drive knob wherein movement of said drive knob into said engaged position operatively couples said engagement rod to said plunger and movement of said drive knob into said unengaged position decouples said engagement rod from said plunger.

16. A fountain pen according to claim 15, further comprising a sleeve to which said drive knob is coupled, wherein in said engaged position said drive knob engages said sleeve to inhibit said drive knob from returning to said unengaged position.

17. A fountain pen according to claim 14, wherein said drive knob is snapably movable between said first and second positions.

18. A method of drawing ink into a piston converter of a fountain pen, the piston converter including a hollow body in fluid communication with a nib and in which a plunger is linearly movable and a drive knob selectively operatively engageable with the plunger to effect linear movement of the plunger, said method comprising:

linearly moving the drive knob from an unengaged position, in which said drive knob is not engaged with the plunger and rotation of said drive knob does not effect linear movement of said plunger, to an engaged position in which the drive knob is operatively engaged with the plunger and rotation of the drive knob causes the plunger to move linearly within the hollow body; and rotating the drive knob to cause the plunger to linearly move away from the nib to increase the volume of the hollow body in fluid communication with the nib.

19. A method according to claim 18, further comprising snapping the drive knob into the unengaged position upon completion of drawing ink into the piston converter.

* * * * *

UNITED STATES PATENT AND TRADEMARK OFFICE

CERTIFICATE OF CORRECTION

PATENT NO. : 6,409,405 B1
DATED : June 25, 2002
INVENTOR(S) : Ryan S. Eddington

It is certified that error appears in the above-identified patent and that said Letters Patent is hereby corrected as shown below:

Column 4,
Line 58, please insert -- to -- before “advance or withdraw”.

Column 5,
Line 48, please replace “where in” with -- wherein --.

Signed and Sealed this

Twenty-ninth Day of June, 2004

JON W. DUDAS
*Acting Director of the United States Patent and Trademark Office*